United States Patent [19]

Shanks

[11] 4,069,993

[45] Jan. 24, 1978

[54] BAG SUPPORTING MEANS

[76] Inventor: Donald L. Shanks, 46 Baywood Ave., Clearwater, Fla. 33515

[21] Appl. No.: 695,204

[22] Filed: June 11, 1976

Related U.S. Application Data

[63] Continuation of Ser. No. 576,318, May 12, 1975, abandoned.

[51] Int. Cl.[2] ..... B65B 67/12

[52] U.S. Cl. ..... 248/97; 248/101; 248/156; 248/316 D

[58] Field of Search ..... 248/97, 99, 100, 101, 248/156, 316 R, 316 D; 24/245 R, 245 B, 245 C, 245 FF, 245 L, 245 A, 245 F, 245 D, 245 E

[56] References Cited

U.S. PATENT DOCUMENTS

| | | | |
|---|---|---|---|
| 637,248 | 11/1899 | Hagstrom | 248/101 |
| 1,665,724 | 4/1928 | Way | 248/101 |
| 2,113,153 | 4/1938 | Jonassen | 248/101 |
| 2,149,042 | 2/1939 | Branthover | 248/97 |
| 2,639,110 | 5/1953 | Nicolas | 248/97 X |
| 3,222,019 | 12/1965 | Weisberg | 248/100 X |
| 3,282,328 | 11/1966 | Mushro et al. | 24/245 A X |
| 3,530,550 | 9/1970 | White | 24/245 A |
| 3,655,157 | 4/1972 | Dalton | 248/97 |
| 3,698,155 | 10/1972 | Robinson | 248/100 X |
| 3,768,763 | 10/1973 | Hembree | 248/97 |

*Primary Examiner*—Roy D. Frazier
*Assistant Examiner*—Rodney H. Bonck
*Attorney, Agent, or Firm*—Stefan M. Stein; Robert F. Frijouf

[57] ABSTRACT

An improved bag supporting means is disclosed for gripping a marginal portion of the mouth of a bag comprising a substantially vertical upright peg fixed at its lower end to a support. A resilient locking ring having an inside diameter less than the diameter of the peg is adapted to be moved downwardly over the peg with the marginal portion of the bag being spread over the peg to hold the bag upon the peg. The locking ring may be affixed to the support by anchor means.

8 Claims, 8 Drawing Figures

BAG SUPPORTING MEANS

CROSS REFERENCE TO RELATED APPLICATIONS:

This is a continuation of application Ser. No. 576,318, filed May 12, 1975 now abandoned.

BACKGROUND OF THE INVENTION

Simple, satisfactory means for dealing with the difficult problem of supporting a trash bag with its mouth held open have not hitherto been designed and made available for general use. This invention is provided to remedy that difficulty.

OBJECTS OF THE INVENTION

The principal objects are to provide a supporting means, adapted easily set up and easily remove a trash bag and to provide simple and effective means for holding the bag in a hanging position with its mouth held open.

Other more specific objects and advantages of this invention will be apparent from the following description and the accompanying drawing.

DETAILED DESCRIPTION OF THE INVENTION

Referring first to the embodiment of FIGS. 1–6, the bag supporting means comprise a relatively rigid, horizontally disposed, open, rectangular frame 10, a pair of uprights stakes 12, the upper ends of which are tightly fitted into sockets 14 provided oppositely in the under side of the frame 10, and the lower ends of which stakes are preferably somewhat pointed for driving into the ground; and plural bag holding pegs 18 mounted in upstanding positions at the four corners of the frame 10.

Figure 1:
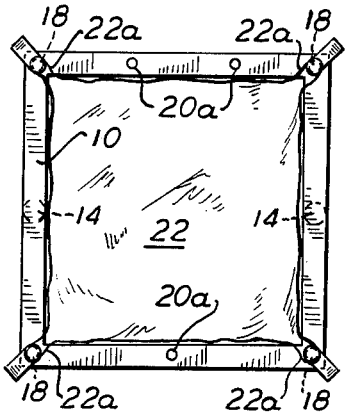
FIG. 1 is a top plan view of a relatively rigid rectangular bag holding frame.

The frame 10 and the stakes 12 may be of suitable light weight material such as wood, plastic, or aluminum, and said material may be either solid or tubular and of square or circular shape in cross-section. The pegs 18 are mounted in apertures or holes 20 in the frame 10 at the corners thereof as more specifically explained hereinafter with reference to FIG. 6. In FIG. 1, four pegs 18 are shown in four corner holes: Additional holes **20*a* are provided at intermediate points in the frame 10 to permit some variation, if desired, in the locations where pegs 18 may be mounted on the frame 10** to accommodate different sizes of bags.

Figure 3:
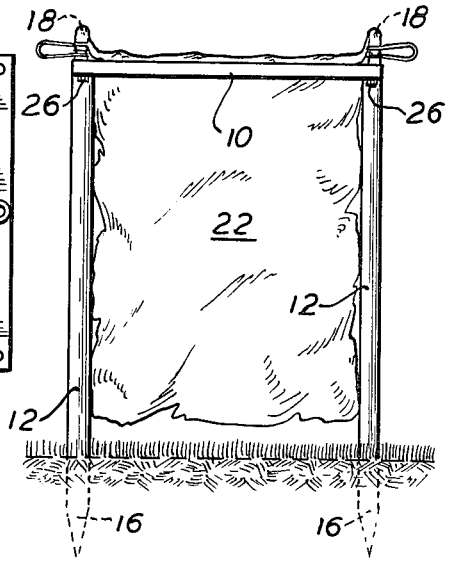
FIG. 3 is a side elevational view showing the bag holding frame supported in a horizontal position by two rigid uprights in the nature of long stakes driven into the ground, and showing a trash bag hanging from the frame and between the uprights.

A trash bag 22, as best seen in FIG. 3, hangs from pegs 18 on the frame 10 and is straddled by the two upright stakes 12.

Figure 4:
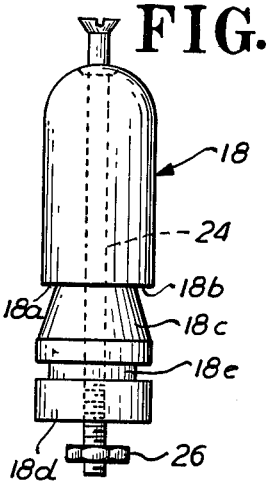
FIG. 4 is a side elevational view of one of plural bag gripping pegs of generally cylindrical shape for readily, releasably securing marginal mouth portions of a trash bag to the bag holding frame.
Figure 5:
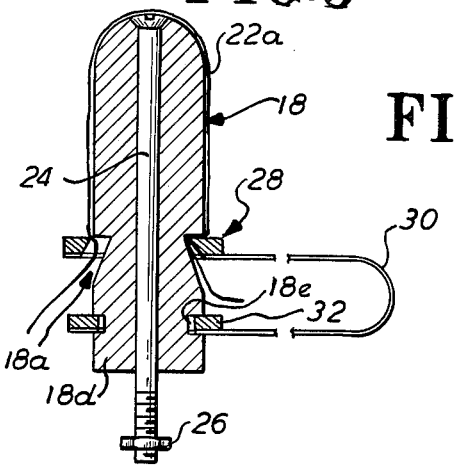
FIG. 5 is a central sectional view of the peg of FIG. 4 on which is sectionally shown a locking ring for locking a trash bag to the peg, and a fragmentary indication of a marginal portion of the trash bag.
Figure 6:
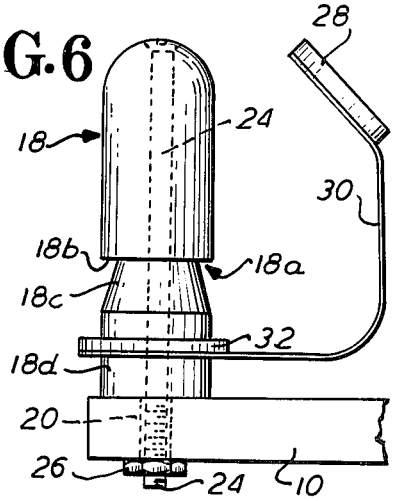
FIG. 6 is a side elevational view of the peg of FIG. 5 with the locking ring in a non-locking position and showing the peg as mounted upon a fragmentally shown portion of the bag holding frame.

A preferred form of peg 18 is best illustrated in FIGS. 4, 5 and 6. It is generally cylindrical in shape and may be of wood, relatively rigid plastic, or other suitable material. A long bolt 24 extends coaxially within the peg 18 from the domed top of the peg to the bottom thereof, whence it extends through a selected hole 20 in the frame 10 to which the peg is fixed by a nut 26 threaded upon the lower end of the bolt 24.

Trash bags such as bag 22 are commonly made of relatively thin plastic sheet material and, to cause the bag to be held by a peg 18, a marginal portion **22*a* of the mouth of the bag 22 is placed over, down, and around the peg as fragmentally indicated in FIG. 5**, possibly being slightly stretched in being so disposed upon the peg. The thus disposed marginal portion of the bag is firmly held upon the peg by a ring arrangement now to be described.

An intermediate portion of the peg 18 is formed with a first area of reduced effective cross-section shown as a first circumferential locking groove **18*a*, preferably having a planar top surface 18*b* and a frusto conical bottom surface 18*c* diverging downwardly from the inner limit of the top surface 18*b*. A locking ring 28, preferably of slightly resilient rubber or plastic material may be manually pushed downwardly over the peg 18 and over the marginal bag portion 22*a*. During an initial part of this pushing, the ring 28 is expanded, partly because of the dome shape of the top of the peg 18 and partly because the inner surface of the ring 28** converges upwardly to some extent.

When the ring 28 has been pushed downwardly into radial alignment with the groove **18*a*, its resiliency causes it to contract into locking engagement with the bag's marginal portion 22*a* and into the groove 18*a*. When it is desired to remove the ring 28 to release the bag, the ring may be forced upwardly whereupon it expands to slide from and off of the top of the peg 18, thus freely the previously held marginal portion 22*a* of the bag 22. It should be understood that the resiliency of the ring 28 is such as to permit the described manipulation thereof both to enable the bag portion 22*a*** to be locked upon the peg and later to be freed therefrom as described.

As thus far described, the locking ring 28 could easily become lost. To prevent this, it is preferred to provide a flexible anchor line 30 the upper end of which is fixed to the ring 28 and the lower end of which is suitably secured to a lower portion **18*d* of the peg 18. One of various ways of thus securing anchor line 30 to the peg's lower portion 18*d* is shown best in FIGS. 5 and 6 as fixedly attaching the lower end of the anchor line 30 to a preferably resilient anchoring ring 32 which is first forcibly expanded over the top of the peg 18, then pushed downwardly thereon past groove 18***a* until it snaps into a second area of reduced cross-sectional area shown as a second circumferential anchoring groove 18*e*. It will be noted from FIG. 6 that the anchor line 30 is long enough and flexible enough to enable the locking ring 28 to be inactively held clear of the peg 18 and also to reach to a position over the top of said peg and over a marginal bag portion 22*a* placed over said peg.

Figure 7:
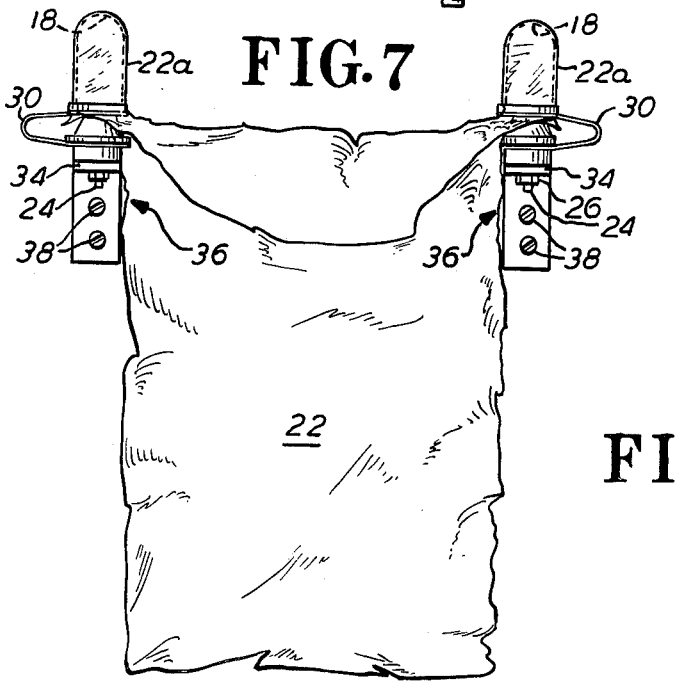
FIG. 7 is an elevational view of two pegs like the peg of FIGS. 5 and 6 as mounted upon an exterior wall surface of a building, with a trash bag supported by the pegs in a hanging position with the bag's mouth at least partially open.

FIG. 7 illustrates how two pegs 18 may be fastened to the exterior of a building wall by securing each peg, by its bolt 24 to a horizontal flange 34 of a sturdy angle bracket 36 and by securing a vertical flange of the angle bracket 36 to the wall of a building by screws or bolts 38. Where only two pegs 18 are used as in FIG. 7, the mouth of the bag 22, while not held wide open, is nevertheless held open sufficiently to enable trash, etc. to be conveniently placed therein. Moreover, as some trash accumulates in the bag, the trash, itself, aids in holding the mouth of the bag open.

Figure 8:
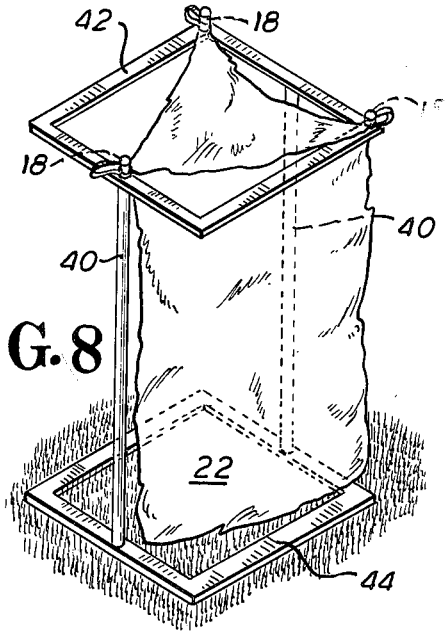
FIG. 8 is a perspective view illustrating the use of a flat base member for receiving the lower ends of the frame holding uprights instead of driving the latter into the ground.

FIG. 8 shows that instead of using stakes 17 driven into the ground, as in FIG. 3, uprights 40 may be used to support frame 42, the lower ends of said uprights being seated firmly in suitable sockets at opposite sides of a base frame 44 which rests upon a substantially flat ground surface. This figure shows the use of only three pegs 18 to hold the top of bag 22 and to keep it open.

Figure 2:
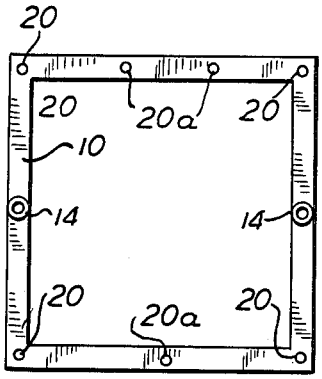
FIG. 2 is a bottom plan view of the frame.

FIGS. 1 and 2 show three unused holes 20 in the frame 10, these excess holes permitting the user to shift the pegs 18 to various combinations of holes, particularly to enable bags of a variety of sizes to be accommodated. The three peg arrangement of FIG. 8, also permits accommodation of smaller bags.

It will be realized that this invention may be practiced in various ways other than as shown herein without departing from the invention as set forth in the following claims.

Now that the invention has been described; I claim:

1. Bag supporting means comprising bag holding means, including bag gripping means for gripping a marginal portion of the mouth of the bag, said bag supporting means including a plurality of pegs having threaded fastener means for securing said pegs to a support, said support including a frame having a plurality of apertures, said plurality of pegs being engageable with selected ones of said apertures for locating said pegs in accordance with the size of the bag, a plurality of resilient locking rings having inside diameters less than the diameter of said pegs and adapted to be moved over said peg with a portion of the bag spread over said pegs to hold the portion of the bag upon said pegs, and anchor means affixing said locking rings to one of said bag holding means or said support.

2. Bag supporting means comprising bag holding means, including bag gripping means for gripping a marginal portion of the mouth of the bag, said bag supporting means including a peg fixed to a support, a resilient locking ring having an inside diameter less than the diameter of said peg and adapted to be moved over said peg with a portion of the bag spread over said peg to hold the portion of the bag upon said peg, said peg including a first area of reduced effective cross-section for receiving said resilient locking ring, and anchor means including a second area of reduced effective cross-section in said peg for affixing said locking ring to said peg.

3. Bag supporting means as set forth in claim 1, each of said pegs has a dome-shaped top to facilitate application of said locking ring thereto during moving the locking ring of said peg.

4. Bag supporting means as set forth in claim, 1 wherein each of said pegs includes an area of reduced effective cross-section for receiving said resilient locking ring.

5. Bag supporting means as set forth in claim 4, including a second area of reduced effective cross section in said peg for receiving said anchor means.

6. Bag supporting means as set forth in claim 1, wherein said support includes an open frame receiving said pegs, and a plurality of vertical uprights for supporting said frame in a substantially horizontal plane with the bag disposed within the open interior area of said open frame between said plurality of vertical uprights.

7. Bag supporting means as set forth in claim 1, wherein said support includes a mounting bracket for mounting said substantially vertical upright pegs relative to a substantially vertical surface.

8. Trash bag supporting means comprising plural bag holding means supported in approximately horizontally aligned, spaced relationship, said bag holding means including bag gripping means for gripping spaced marginal portions of the mouth of a trash bag; said bag supporting means further including a relatively rigid open frame, substantially vertical uprights fixed at their upper ends to spaced points on said frame and including means at their lower ends for holding said uprights in upright positions with said frame in an approximately horizontal position; said bag holding means and said bag gripping means being carried in spaced positions on and about said frame to hold a related trash bag or the like depending from an open interior area of said frame into an area between said uprights; said bag holding and gripping means comprising plural generally cylindrical pegs, fixed at their lower ends at spaced locations on said frame, said pegs each being formed with a circumferential locking groove therein distal from the peg's top, and a resilient locking ring having an inside diameter less than the general diameter of the peg and adapted to be moved downwardly over said peg with a trash bag portion spread over said peg and to snap into said locking groove to hold said bag portion upon the peg; said locking ring having one end of a flexible anchor line fixed thereto, and said anchor line's other end being fixed to an anchoring ring seated within a second circumferential groove of the peg, located below said locking groove of the peg.

* * * * *

UNITED STATES PATENT AND TRADEMARK OFFICE

CERTIFICATE OF CORRECTION

PATENT NO. : 4,069,993
DATED : January 24, 1978
INVENTOR(S) : Donald L. Shanks

It is certified that error appears in the above-identified patent and that said Letters Patent are hereby corrected as shown below:

Col. 1, line 18, after "adapted" insert --to--

Col. 2, line 53, "freely" should be --freeing--

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*